US007147008B2

(12) United States Patent
Sayler

(10) Patent No.: US 7,147,008 B2
(45) Date of Patent: Dec. 12, 2006

(54) STRING BEAD LOOM

(76) Inventor: Wayne E. Sayler, 2475 Highway 215, Buffalo, MO (US) 65622

( * ) Notice: Subject to any disclaimer, the term of this patent is extended or adjusted under 35 U.S.C. 154(b) by 71 days.

(21) Appl. No.: 10/905,640

(22) Filed: Jan. 14, 2005

(65) Prior Publication Data

US 2006/0157137 A1 Jul. 20, 2006

(51) Int. Cl.
*D03D 29/00* (2006.01)

(52) U.S. Cl. ..... 139/29; 139/11

(58) Field of Classification Search ..... 139/11, 139/29–33, 34; 223/48
See application file for complete search history.

(56) References Cited

U.S. PATENT DOCUMENTS

| | | | | |
|---|---|---|---|---|
| 538,022 | A | 4/1895 | Lapworth | |
| 737,073 | A * | 8/1903 | Bush | 28/151 |
| 2,414,663 | A * | 1/1947 | Parton | 139/33 |
| 2,504,940 | A * | 4/1950 | Wallach | 28/151 |
| 2,802,255 | A * | 8/1957 | Wallach | 28/151 |
| 3,545,069 | A | 12/1970 | Krieger | |
| 3,708,862 | A | 1/1973 | Powell, Jr. | |
| 4,027,704 | A | 6/1977 | Romanin | |
| 4,100,943 | A | 7/1978 | Terada et al. | |
| 4,154,267 | A * | 5/1979 | Orr et al. | 139/29 |
| 5,592,835 | A | 1/1997 | Herr | |
| 6,719,013 | B1 * | 4/2004 | D'Estais | 139/29 |

* cited by examiner

*Primary Examiner*—Gary L. Welch
*Assistant Examiner*—Andrew W. Sutton
(74) *Attorney, Agent, or Firm*—Donald R. Schoonover

(57) ABSTRACT

A string bead loom includes a body having a top side, a bottom side, and a rear edge; source means for providing and dispensing string wherein the source means is mounted on the top side of the body; guide means for guiding string being dispensed from the source means; and takeup mechanism for receiving string dispensed from the source means wherein the takeup mechanism is mounted on the bottom side of the body; and wherein the string being dispensed from the source means is guided by the guide means, entrained around the rear edge of the body, and releasably secured to the takeup mechanism.

11 Claims, 2 Drawing Sheets

STRING BEAD LOOM

BACKGROUND OF THE INVENTION

The present invention relates to hand crafts and, more specifically without limitation, to looms and weaving.

Various types of hand crafts are applied and used by a multitude of individuals, not only as a hobby but also for commercial purposes. Handicraft items include enhancements for clothing, clothing accessories, ceremonial artifacts, etc., such as those fashioned by Native Americans and groups, such as Boy Scouts and Girl Scouts, for example.

Many of those items comprise parallel arrays of strings that form a framework for holding beads in various patterns. Such work is generally performed on a loom that supports the parallel-arrayed strings as beads are mounted thereon. Unfortunately, most if not all prior art bead looms do not maintain proper tension on individual strings while beads are being mounted on the strings. As a result, most beadwork formed on prior art looms is loose and uneven. Further, most prior art bead looms can provide only very limited lengths of string. As a result, the lengths of beadwork that can be produced on those looms is also limited.

What is needed is a bead loom that can maintain proper tension on each individual string of a parallel array of strings as beads are being mounted thereon. What is also needed is a bead loom that enables lengthy beadwork to be formed without having to change strings or splice strings together.

PRINCIPAL OBJECTS OF THE INVENTION

The principal objects and advantages of the present invention include: providing a bead loom that can maintain proper tension on each individual string of a parallel array of strings as beads are being mounted on the strings; providing such a bead loom that enables lengthy beadwork to be formed without having to change strings or splice strings together; and generally providing such a bead loom that is reliable in performance, capable of long lasting life, and particularly well adapted for the proposed usages thereof.

Other objects and advantages of this invention will become apparent from the following description taken in conjunction with the accompanying drawings wherein are set forth, by way of illustration and example, certain embodiments of this invention.

SUMMARY OF THE INVENTION

The improvements of the string bead loom of the present invention include a body having a top side, a bottom side, and a rear edge; a pair of opposing, linearly spaced rows of spindles secured to, and extending perpendicularly outwardly from, the top side of the body wherein the spacing between the pair of rows diverges rearwardly; a plurality of string-containing bobbins, each bobbin rotatably mounted on a respective one of the plurality of spindles such that the string contained thereon is dispensable rearwardly therefrom; a plurality of first tensioning mechanisms, each structured to selectively tension string being dispensed from a respective one of the plurality of bobbins; a first bridge element secured to, and extending perpendicularly outwardly from, the top side of the body wherein the first bridge element is spaced rearwardly from the plurality of bobbins and wherein the first bridge element has a plurality of parallel spaced slots forming a comb-like structure along a top edge thereof; a second bridge element secured to, and extending perpendicularly outwardly from, the top side of body wherein the second bridge element is spaced rearwardly from the first bridge element; a takeup mechanism including a pair of opposing mounting mechanisms secured to, and extending outwardly from, the bottom side of the body, and a transversely oriented reel rotatably mounted between the pair of opposing mounting mechanisms; and a second tensioning mechanism for selectively tensioning the reel; and wherein, the strings being dispensed from the plurality of bobbins is entrained over the first and second bridge elements and around the rear edge of the body and is operatively and releasably secured to the reel of the takeup mechanism.

BRIEF DESCRIPTION OF THE DRAWING FIGURES

DETAILED DESCRIPTION OF THE PREFERRED EMBODIMENT

Figure 1:
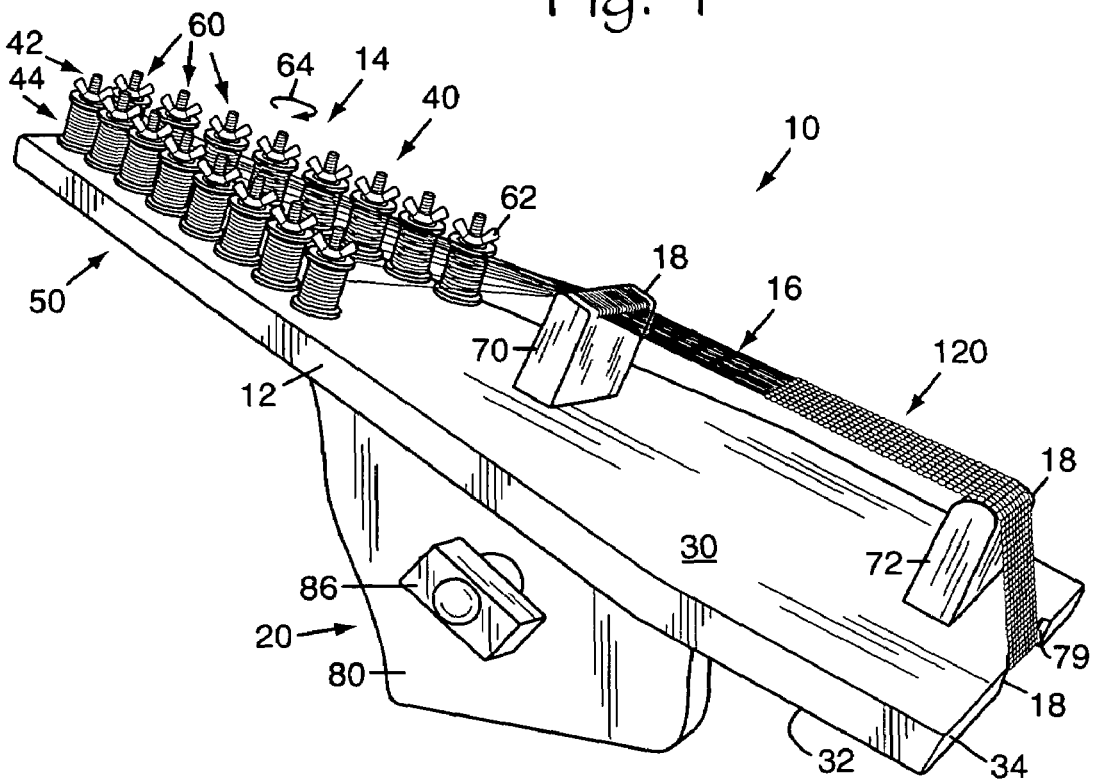
FIG. 1 is a perspective view of a string bead loom, in accordance with the present invention.

As required, embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for claims and as a representative basis for teaching one skilled in the art to variously employ the present invention in virtually any appropriately detailed structure.

The reference numeral 10 generally refers to a string bead loom in accordance with the present invention, as shown in FIGS. 1 through 6. The string bead loom 10 includes a body 12, a source means 14 for providing and dispensing string 16, guide means 18 for guiding string 16 being dispensed from the source means 14, and takeup mechanism 20 for receiving string 16 dispensed from the source means 14.

The body 12, which is constructed of rigid material such as wood, metal, plastic or other suitable material, includes a top side 30, a bottom side 32, and a rear edge 34, as shown in FIG. 1.

Figure 2:
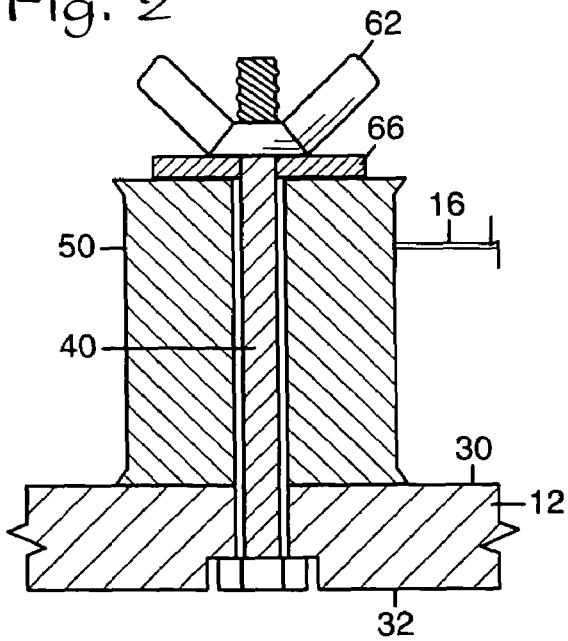
FIG. 2 is an enlarged, fragmentary and cross-sectional view of a spindle, bobbin, and first tensioning means of the string bead loom.

The source means 14 is securely mounted on the top side 30 of the body 12. The source means 14 includes a plurality of bolts or spindles 40 secured to, and extending perpendicularly outwardly from, the top side 30 of the body 12, as shown in FIGS. 1 and 2. The number of spindles depends on the number of strings needed for a particular application of the string bead loom 10. It is to be understood that the number of spindles 40 of the string bead loom 10 may be greater than the number of strings needed for a particular application. In that event, only the number of the spindles 40 equal to the number of strings needed for that particular application would be used Preferably, the plurality of spindles 40 comprises a pair of opposing, linearly spaced rows of spindles 42, 44. Also preferably, the spacing between the pair of opposing, linearly spaced rows of spindles 42, 44 diverges toward the rear edge 34 of the body 12.

It is to be understood that for some applications, it may be desirable that the plurality of spindles 40 may be arranged in a single, linearly spaced row. For other applications, it may be desirable that the plurality of spindles 40 be non-linearly spaced, whether they be in a single row or otherwise.

The source means 14 further includes a plurality of string-containing spools or bobbins 50 wherein each bobbin is rotatably mounted on a respective one of the plurality of spindles 40 such that the string 16 contained thereon is dispensable rearwardly therefrom, as shown in FIGS. 1 and 2. The source means 14 also includes a plurality of first tensioning mechanisms 60, each structured to selectively tension string 16 being dispensed from a respective one of the plurality of bobbins 50. For example, each first tensioning mechanism may include a wingnut 62 threadably secured to a respective one of the plurality of spindles 40, as shown in FIG. 2. Tension in the string 16 being dispensed from the respective spindle can be increased by threadably advancing the wingnut 62 toward the body 12, as indicated by the arrow designated by the numeral 64 in FIG. 1, to thereby increase the frictional resistance opposing the rotation of the bobbin 50 about the spindle 40. For some applications, it may be desirable to provide a washer 66 or other suitable device between each wingnut 62 and the respective bobbin 50 to provide a suitable bearing surface for that wingnut 62.

Figure 3:
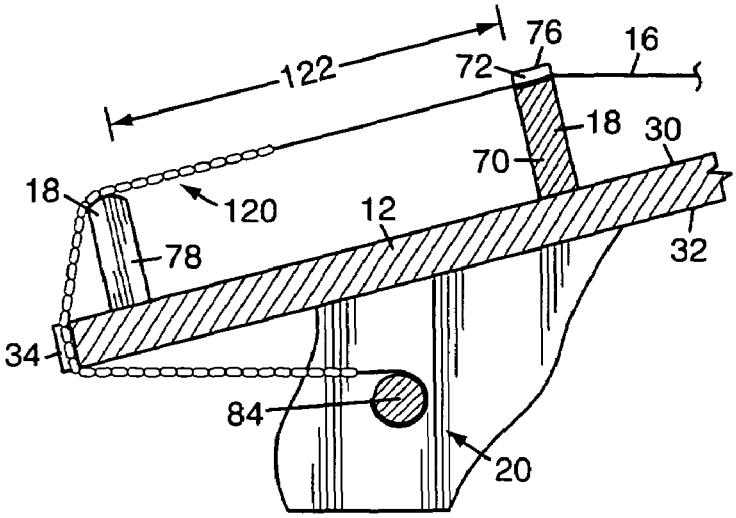
FIG. 3 is a fragmentary and cross-sectional view of the string bead loom, showing portions of a guide means thereof.
Figure 4:
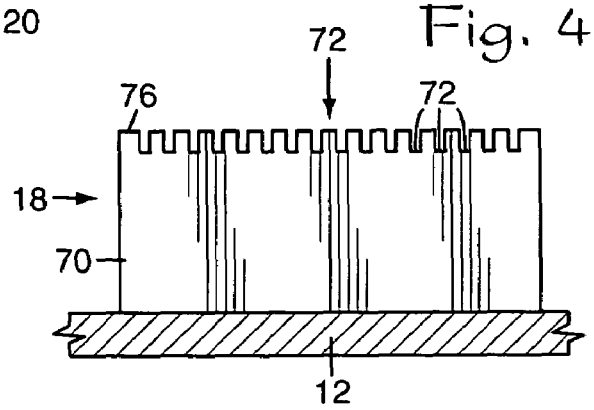
FIG. 4 is an enlarged and fragmentary elevational view of the string bead loom, showing a first bridge element thereof.

The guide means 18 includes a first bridge element 70 secured to, and extending perpendicularly outwardly from, the top side 30 of the body 12, as shown in FIG. 3. The first bridge element 70 is spaced rearwardly from the source means 14. The first bridge element 70 has a plurality of parallel spaced slots 72 forming a comb-like structure 74 along a top edge 76 thereof, as shown in FIG. 4. The spacing between the slots 72 is approximately equal to the width of beads which will be used with the string bead loom 10.

The guide means 18 also includes a second bridge element 78 secured to, and extending perpendicularly outwardly from, the top side 30 of body 12, as shown in FIG. 3. The second bridge element 78 is spaced rearwardly from the first bridge element 70. For some applications, it may be desirable to also include a plurality of parallel spaced slots forming a comb-like structure along a top edge of the second bridge element 78, similar to that shown in FIG. 4 for the first bridge element 70. The spacing between those slots is approximately equal to the spacing between slots 72 of the first bridge element 70 in order to hold the strings between the first and second bridge elements 70, 78 in a parallel arrangement.

Figure 5:
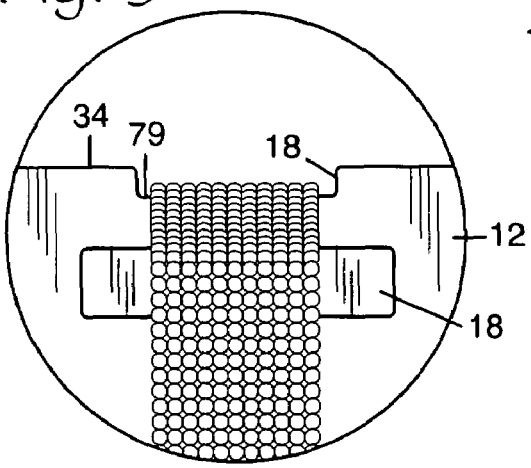
FIG. 5 is an enlarged and fragmentary top plan view of the string bead loom, showing a throat in a rear edge thereof.

Also, for some applications, it may be desirable that a top surface of the second bridge element 78 have a concave downwardly recess. Further, the guide means 18 may include a similar recess or throat 79 in the rear edge 34 of the body 12, as shown in FIG. 5.

Figure 6:
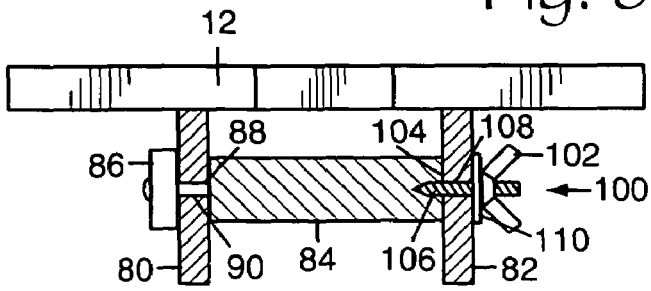
FIG. 6 is a fragmentary and partially cross-sectional view of the string bead loom, showing a takeup mechanism thereof, in accordance with the present invention.

The takeup mechanism 20, which is mounted on the bottom side 32 of the body 12, includes first and second opposing mounting mechanisms 80, 82 secured to, and extending outwardly from, the bottom side 32 of the body 12, as shown in FIG. 6. The takeup mechanism 20 also includes a transversely oriented reel 84 rotatably mounted between the first and second opposing mounting mechanisms 80, 82. A T-shaped handle 86 is securely connected to a first end 88 of the reel 84 via an orifice 90 through the first mounting mechanism 80.

The takeup mechanism 20 also includes a second tensioning mechanism 100 for selectively tensioning the reel 84. For example, the second tensioning mechanism 100 may include a wingnut 102 threadably secured to a second end 104 of the reel 84, such as by a threaded stud 106 securely connected to the second end 104 via an orifice 108 through the second mounting mechanism 82. Tension cooperatively provided by the second end 104 of the reel 84 and the second tensioning mechanism 100 can be increased by threadably advancing the wingnut 102 toward the reel 84 to thereby increase the frictional resistance opposing the rotation of the reel 84 between the first and second mounting mechanisms 80, 82. For some applications, it may be desirable to provide a washer 110 between the wingnut 102 and the second mounting mechanism 82 to provide a suitable bearing surface for the wingnut 102.

In an application of the string bead loom 10 of the present invention, a plurality of string-containing bobbins 50 are placed on the spindles 40, the number of bobbins 50 being equal to the number of strings needed for the application. The ends of the strings 16 on the bobbins 50 are tied together and pulled rearwardly such that the strings 16 can be separately placed in a side-by-side parallel arrangement using in adjacent ones of the slots 72 of the first bridge element 70. The tied-together ends of the strings 16 are then pulled rearwardly such that the parallel arrangement of strings 16 can be entrained over the second bridge element 78 and around the throat 79 of the rear edge 34 of the body 12. The tied-together ends of the strings 16 is then releasably secured to the reel 84 of the takeup mechanism 20, such as with tape, adhesive, or other suitable means. The handle 86 is then turned to begin rolling the ends of the parallel arrangement of strings 16 onto the reel 84 and to develop tension in the parallel arrangement of strings 16. If the desired tension cannot be developed in the parallel arrangement of strings 16, the second tensioning mechanism 100 is adjusted accordingly. If the desired tension cannot be developed in particular ones of the parallel arrangement of strings 16, the corresponding first tensioning mechanisms 60 are adjusted accordingly. After desired tensioning is developed in the parallel arrangement of strings 16, the user can begin producing beadwork 120 in looming area 122, as shown in FIG. 3, by methods known to those skilled in the bead-looming art. As area 122 becomes filled with beadwork 120, handle 86 is turned to thereby remove the completed beadwork 120 from most of area 122 and rolling that completed beadwork 120 onto the reel 84. Additional beadwork 120 can then be produced adjacent to the beadwork 120 which has already been completed. Based on this disclosure, it should now be obvious that the continuous length of beadwork, without splicing strings, that can be obtained by use of the string bead loom 10 is limited only by the length of string 16 that can be contained on each of the bobbins 50, which is substantially longer than that obtainable by use of prior art string bead looms.

It is to be understood that while certain forms of the present invention have been illustrated and described herein, it is not to be limited to the specific forms or arrangement of parts described and shown.

What is claimed is:

1. A string bead loom, comprising:

(a) a body having a top side, a bottom side, and a rear edge;

(b) source means for providing and dispensing string, the source means being mounted on the top side of the body, wherein the source means includes a plurality of spindles secured to, and extending perpendicularly outwardly from, the top side of the body, and wherein the plurality of spindles includes a pair of opposing, linearly spaced rows of spindles, the spacing between the pair of opposing, linearly spaced rows of spindles diverging rearwardly;

(c) guide means for guiding string being dispensed from the source means; and (d) takeup mechanism for receiving string dispensed from the source means, the takeup mechanism being mounted on the bottom side of the body; and (e) wherein the string being dispensed from the source means is guided by the guide means, entrained around the rear edge of the body, and releasably secured to the takeup mechanism.

2. The string bead loom as described in claim 1 wherein the source means further includes a plurality of string-containing bobbins, each bobbin rotatably mounted on a respective one of the plurality of spindles such that the string contained thereon is dispensable rearwardly therefrom.

3. The string bead loom as described in claim 2 wherein the source means further includes a plurality of first tensioning mechanisms, each structured to selectively tension string being dispensed from a respective one of the plurality of bobbins.

4. The string bead loom as described in claim 1 wherein the guide means includes a first bridge element secured to, and extending perpendicularly outwardly from, the top side of the body; the first bridge element being spaced rearwardly from the source means.

5. The string bead loom as described in claim 4 wherein the first bridge element includes a plurality of parallel spaced slots forming a comb-like structure along a top edge thereof.

6. The string bead loom as described in claim 4 wherein the guide means further includes a second bridge element secured to, and extending perpendicularly outwardly from, the top side of body; the second bridge element being spaced rearwardly from the first bridge element.

7. The string bead loom as described in claim 6 wherein the second bridge element includes a plurality of parallel spaced slots forming a comb-like structure along a top edge thereof.

8. The string bead loom as described in claim 1 wherein the takeup mechanism includes a pair of opposing mounting mechanisms secured to, and extending outwardly from, the bottom side of the body.

9. The string bead loom as described in claim 8, wherein the takeup mechanism further includes a transversely oriented reel rotatably mounted between the pair of opposing mounting mechanisms.

10. The string bead loom as described in claim 9, wherein the takeup mechanism further includes a second tensioning mechanism for selectively tensioning the reel.

11. A string bead loom, comprising:

(a) a body having a top side, a bottom side, and a rear edge;

(b) a pair of opposing, linearly spaced rows of spindles secured to, and extending perpendicularly outwardly from, the top side of the body wherein the spacing between the pair of rows diverges rearwardly;

(c) a plurality of string-containing bobbins, each bobbin rotatably mounted on a respective one of the plurality of spindles such that the string contained thereon is dispensable rearwardly therefrom;

(d) a plurality of first tensioning mechanisms, each structured to selectively tension string being dispensed from a respective one of the plurality of bobbins;

(e) a first bridge element secured to, and extending perpendicularly outwardly from, the top side of the body; the first bridge element being spaced rearwardly from the plurality of bobbins;

(f) a second bridge element secured to, and extending perpendicularly outwardly from, the top side of body; the second bridge element being spaced rearwardly from the first bridge element;

(g) a takeup mechanism including (1) a pair of opposing mounting mechanisms secured to, and extending outwardly from, the bottom side of the body, and (2) a transversely oriented reel rotatably mounted between the pair of opposing mounting mechanisms; and (h) a second tensioning mechanism for selectively tensioning the reel; and (i) wherein, the strings being dispensed from the plurality of bobbins is entrained over the first and second bridge elements and around the rear edge of the body, and is operatively and releasably secured to the reel of the takeup mechanism.

* * * * *